US006883617B2

(12) United States Patent
Putney et al.

(10) Patent No.: US 6,883,617 B2
(45) Date of Patent: Apr. 26, 2005

(54) AIR AUTO SHUT-OFF

(75) Inventors: Gordon A. Putney, Lake Geneva, WI (US); Daniel S. Pusateri, Grayslake, IL (US); Dean J. Iwinski, Muskego, WI (US); Daniel D. Lionberg, Milwaukee, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/431,958

(22) Filed: May 8, 2003

(65) Prior Publication Data

US 2003/0226674 A1 Dec. 11, 2003

Related U.S. Application Data

(60) Provisional application No. 60/379,071, filed on May 9, 2002.

(51) Int. Cl.[7] ..... E21B 7/00
(52) U.S. Cl. ..... 173/1; 173/90
(58) Field of Search ..... 173/90, 176, 177, 173/178, 180, 181, 183; 137/50, 57; 251/89

(56) References Cited

U.S. PATENT DOCUMENTS

| | | | | |
|---|---|---|---|---|
| 2,727,598 A | | 12/1955 | Mitchell et al. | |
| 2,768,546 A | | 10/1956 | Amtsberg | |
| 2,973,069 A | | 2/1961 | Sturrock | |
| 3,315,754 A | | 4/1967 | Holdo et al. | |
| 3,368,631 A | * | 2/1968 | MacNaughton | 173/177 |
| 3,643,749 A | | 2/1972 | Pauley | |
| 3,703,933 A | | 11/1972 | Schoeps | |
| 3,920,082 A | | 11/1975 | Dudek | |
| 3,930,764 A | * | 1/1976 | Curtiss | 418/43 |
| 4,004,859 A | * | 1/1977 | Borries | 415/25 |
| 4,113,080 A | * | 9/1978 | Thackston et al. | 192/150 |
| 4,359,107 A | | 11/1982 | Smith | |
| 4,402,138 A | | 9/1983 | Glöckle et al. | |
| 4,899,598 A | * | 2/1990 | Gumaste et al. | 73/862.335 |
| 4,903,783 A | * | 2/1990 | Rushanan et al. | 173/177 |
| 5,155,421 A | | 10/1992 | Hansson | |
| 5,201,373 A | | 4/1993 | Bloechle | |
| 5,289,885 A | | 3/1994 | Sakoh | |
| 5,366,132 A | | 11/1994 | Simonelli | |
| 5,492,185 A | | 2/1996 | Schoeps et al. | |
| 5,544,710 A | | 8/1996 | Groshans et al. | |
| 5,573,074 A | | 11/1996 | Thames et al. | |
| 5,704,435 A | | 1/1998 | Meyer et al. | |
| 5,868,208 A | | 2/1999 | Peisert et al. | |
| 5,887,335 A | | 3/1999 | Garshells | |
| 5,984,020 A | | 11/1999 | Meyer et al. | |
| 6,158,526 A | | 12/2000 | Ghode et al. | |

FOREIGN PATENT DOCUMENTS

EP 0502748 6/1996

OTHER PUBLICATIONS

Chicago Pneumatic Tool Company—Catalog page for CP2700 Series Shut–Off Pulse Nut Runners (1992).
Gardner–Denver Manual p. 8 (prior to 2002).
Drawing (2 sheets) for Snap–on PH2050 Air Hammer (prior to 2000).
Atlas–Copco Catalog page for ErgoPulse PT–TRIM nutrunners with auto shut–off (prior to 2002).

* cited by examiner

*Primary Examiner*—Louis Huynh
*Assistant Examiner*—Nathaniel Chukwurah
(74) *Attorney, Agent, or Firm*—Seyfarth Shaw LLP

(57) ABSTRACT

An automatic shutoff mechanism is designed for a pneumatic tool having an air motor, a pressurized airflow path to the motor and a torquing mechanism driven by the motor. The shutoff mechanism includes a valve member moveable between open and closed positions relative to the airflow path and biased to the open position. A trip apparatus is responsive to application of a predetermined torque for moving the valve member to a trip position disposed in the airflow path sufficiently to expose the valve member to the pressurized airflow for driving the valve member from the trip position to the closed position. Mechanical and electromechanical embodiments are disclosed.

32 Claims, 12 Drawing Sheets

AIR AUTO SHUT-OFF

RELATED APPLICATION

This application claims the benefit of the filing date of U.S. Provisional Application No. 60/379,071, filed May 9, 2002, now abandoned.

BACKGROUND

This application relates to pneumatic tools and, in particular, to control mechanisms therefore. The application relates specifically to shutoff mechanisms for disconnecting a pneumatic motor from a supply of pressurized pneumatic fluid.

Pneumatically operated tools of varying types are known, including a wide variety of pneumatically-operated hand tools. Many such tools are designed for torque application to a workpiece and may include devices such as screw or nut driving tools, impact wrenches and the like. Such tools are typically provided with a trigger valve mechanism to manually control the flow of pressurized pneumatic fluid, typically air, to an air motor. Some pneumatic tools are also provided with automatic shutoff mechanisms, responsive to a particular event or condition, such as the application of a predetermined torque level. Such prior shutoff arrangements have typically been rather complex, bulky, expensive, relative slow acting and/or difficult to adjust.

SUMMARY

There is disclosed herein an improved technique for automatic shutoff of a pneumatic tool.

The technique includes use of a valve member biased to a normal open position and a trip apparatus responsive to application of a predetermined torque by the tool for moving the valve member into the pressurized airflow path a distance sufficient that the airflow itself will then drive the valve member to a closed position, shutting off airflow to the motor.

In a mechanical embodiment of the shutoff mechanism, the trip assembly includes an inertia member coaxial with the motor rotor shaft and a helical coupling between the inertia member and the rotor shaft such that they rotate together at constant velocity, but that upon rapid deceleration of the rotor shaft the inertia member moves rotatably and axially relative to the rotor shaft to a position spaced from the valve member a distance inversely proportional to the torque applied by the tool, the trip assembly moving the inertia member into engagement with the valve member upon application of the predetermined torque.

Where the pneumatic tool is an impact tool, in one mechanical embodiment of the shutoff mechanism the inertia member is biased to a home position spaced a maximum distance from the valve member and, in response to each impact, moves toward the valve member a distance proportional to the torque applied and then back to the home position.

In another embodiment, the trip assembly includes a clutch mechanism responsive to movement of the inertia member from its home position for preventing its return to the home position until the valve has been tripped, and preventing premature tripping upon transition from free run down of a fastener to initial torque resistance.

In another embodiment, the shutoff mechanism is electromechanically operated, the valve member being a solenoid actuated in response to a torque sensing device.

There is also a disclosed method for automatically shutting off a pneumatic torque-applying tool when a predetermined torque is reached by disposing a valve member adjacent to the pressured airflow path upstream of the motor and, when the predetermined torque is reached, moving the valve member from its open position to a trip position disposed in the airflow path and spaced from the open position a distance such that the valve member is exposed to a pressured air load which drives it to the closed position.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
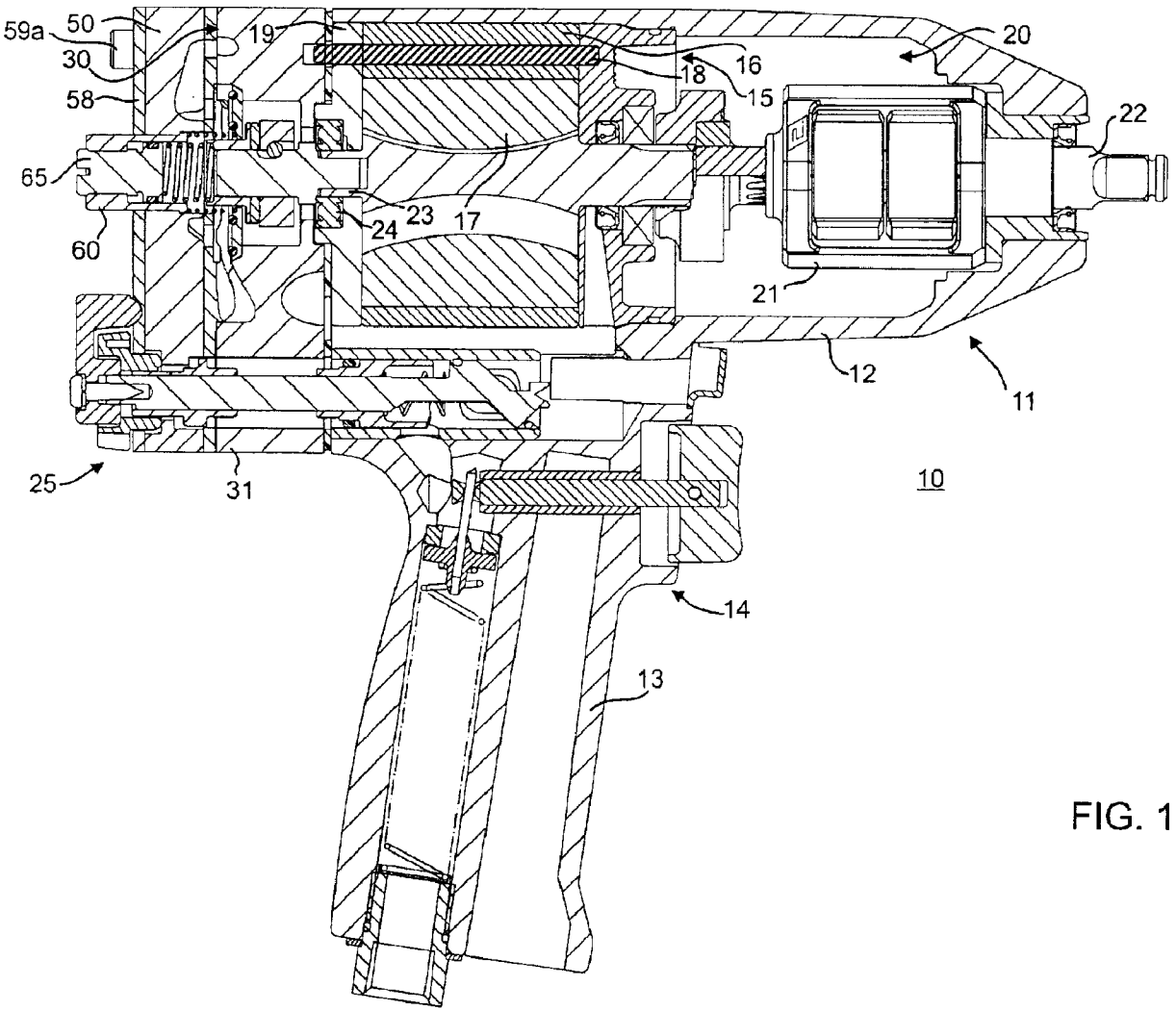
FIG. 1 is a vertical sectional view of a pneumatic impact tool having an automatic shutoff mechanism in accordance with a first embodiment.

Referring to FIG. 1, there is illustrated a pneumatic torquing tool 10 in the nature of an impact tool, having a housing 11 with an elongated, generally cylindrical barrel portion 12 and a depending handle portion 13 cooperating to define a known pistol grip configuration. The distal end of the handle portion 13 is adapted to be coupled to a source of pressurized pneumatic fluid, such as air, in a known manner, the airflow to the motor being controlled by a known trigger valve assembly 14. Mounted in the barrel portion 12 of the housing 11 is a known air motor 15 having a cylinder 16 surrounding a rotor 17 provided with a plurality of circumferentially spaced and radially extending vanes, the front and rear ends of the motor 15 being respectively closed by front and rear end plates 18 and 19, again all in a known manner. Coupled to the forward or output end of the rotor 17 is an output mechanism 20, which, in the illustrated embodiment, includes a torquing mechanism in the nature of a known impact mechanism 21, which may be of the double dog type. The output mechanism 20 also includes an output member 22 which is connected to the impact mechanism 21 and is adapted for coupling to a suitable drive tool, such as a socket, for coupling to an associated fastener or other work piece to which torque is to be applied, again all in a known manner. The rear end of the rotor 17 defines a stub shaft 23 journaled in a bearing 24. The tool 10 may also be provided with a reversing valve assembly 25, again of a known construction, for cooperation with the trigger valve assembly 14 to control the direction of rotation of the air motor 15. In operation, the valve assemblies 14 and 25 channel the input pressurized airflow through passageways to the rear of the housing 11, where the airflow enters the air motor 15, exiting at the forward end thereof. The passages permit the pressured air stream to enter the rear of the air motor 15 at different locations, depending upon the condition of the reversing valve assembly 25, as will be explained more fully below.

Figure 7:
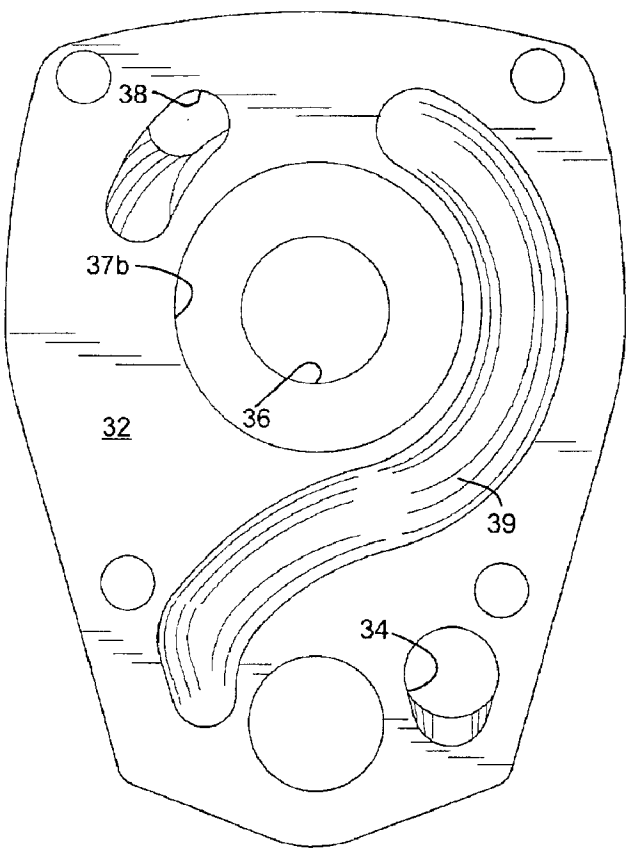
FIG. 7 is a front elevational view of the valve plate of FIG. 5.
Figure 6:
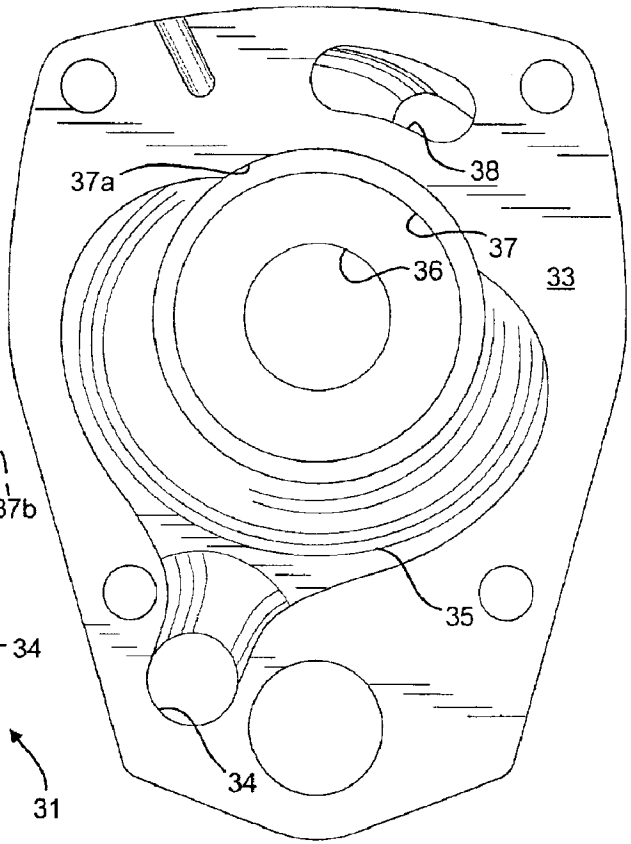
FIG. 6 is a rear elevational view of the valve plate of FIG. 5.
Figure 5:
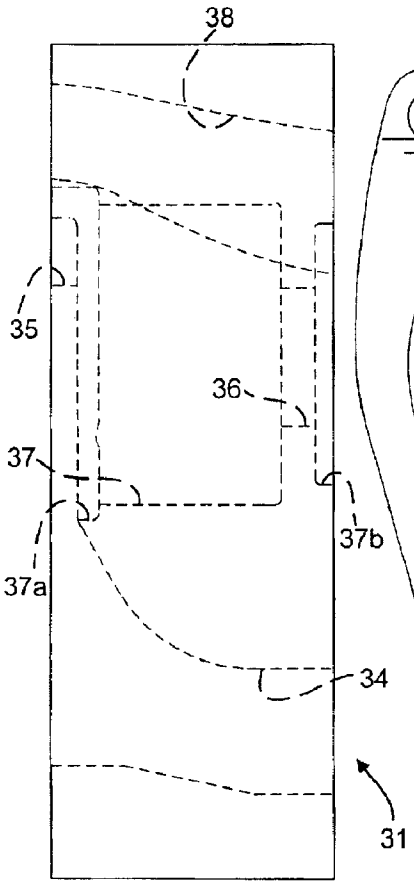
FIG. 5 is a side elevational view of the valve plate of the shutoff mechanism of FIG. 3.
Figure 9:
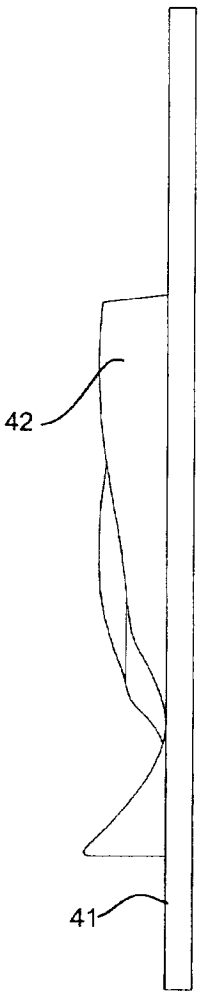
FIG. 9 is a side elevational view of the valve seat of FIG. 8.
Figure 8:
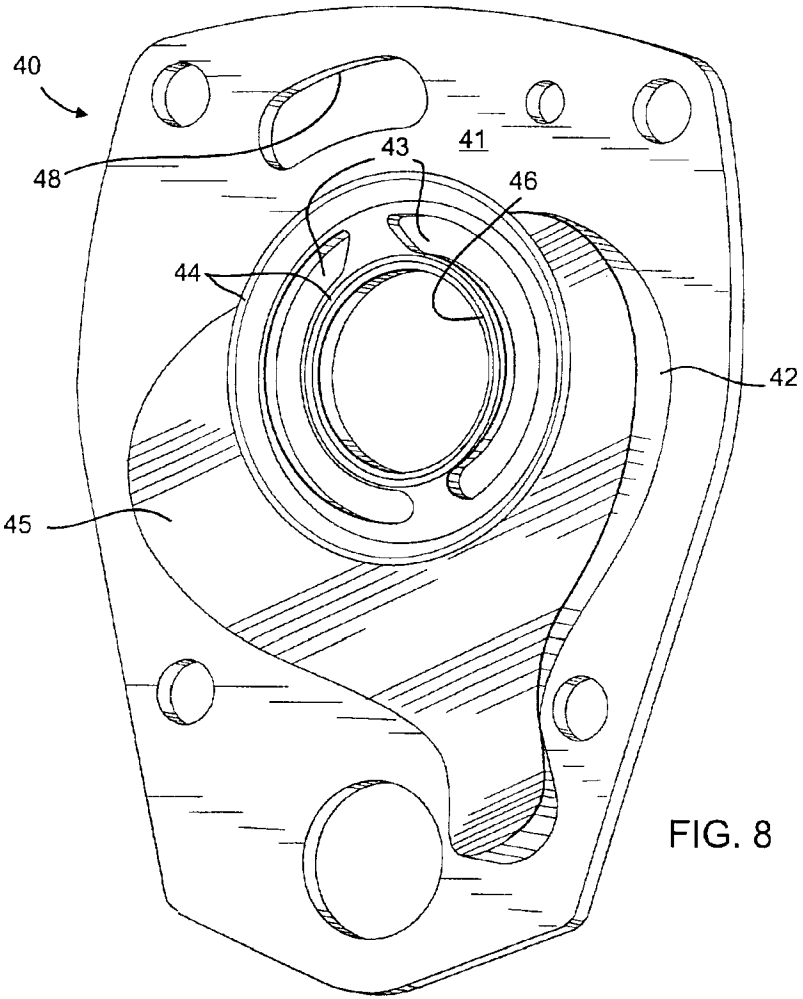
FIG. 8 is a front perspective view of the valve seat of the shutoff mechanism of FIG. 3.

Referring now also to FIGS. 2–9, the pneumatic tool 10 is provided at its rear end with an automatic shutoff mechanism, generally designated by the numeral 30 (FIGS. 1 and 2) for automatically shutting off the air motor 15 upon the occurrence of a predetermined event, such as the development of a predetermined reactive force on the tool which, in the embodiment of FIGS. 1–9, corresponds to the application of a predetermined torque to the associated work piece. The shutoff mechanism 30 includes a valve plate 31 having a front face 32 and a rear face 33 (see FIGS. 5–7), with an inlet port 34 extending therethrough between the two faces. Formed in the rear face 33 and communicating with the port 34 is a generally Y-shaped groove 35, the arms of which partially encircle a central cylindrical bore 36 formed through the plate 31 and provided at the rear face 33 with a first relatively deep counterbore 37 and a larger-diameter shallow counter bore 37*a*. The bore 36 is also provided with a counterbore 37*b* in the front face 32 (FIG. 7). Formed through the plate 31 adjacent to its upper end is an arcuate port 38. Formed in the front face 32 of the valve plate 31 is a generally question mark-shaped groove 39, which partially encircles the central bore 36 for reversing the direction of the air motor 15.

Figure 2:
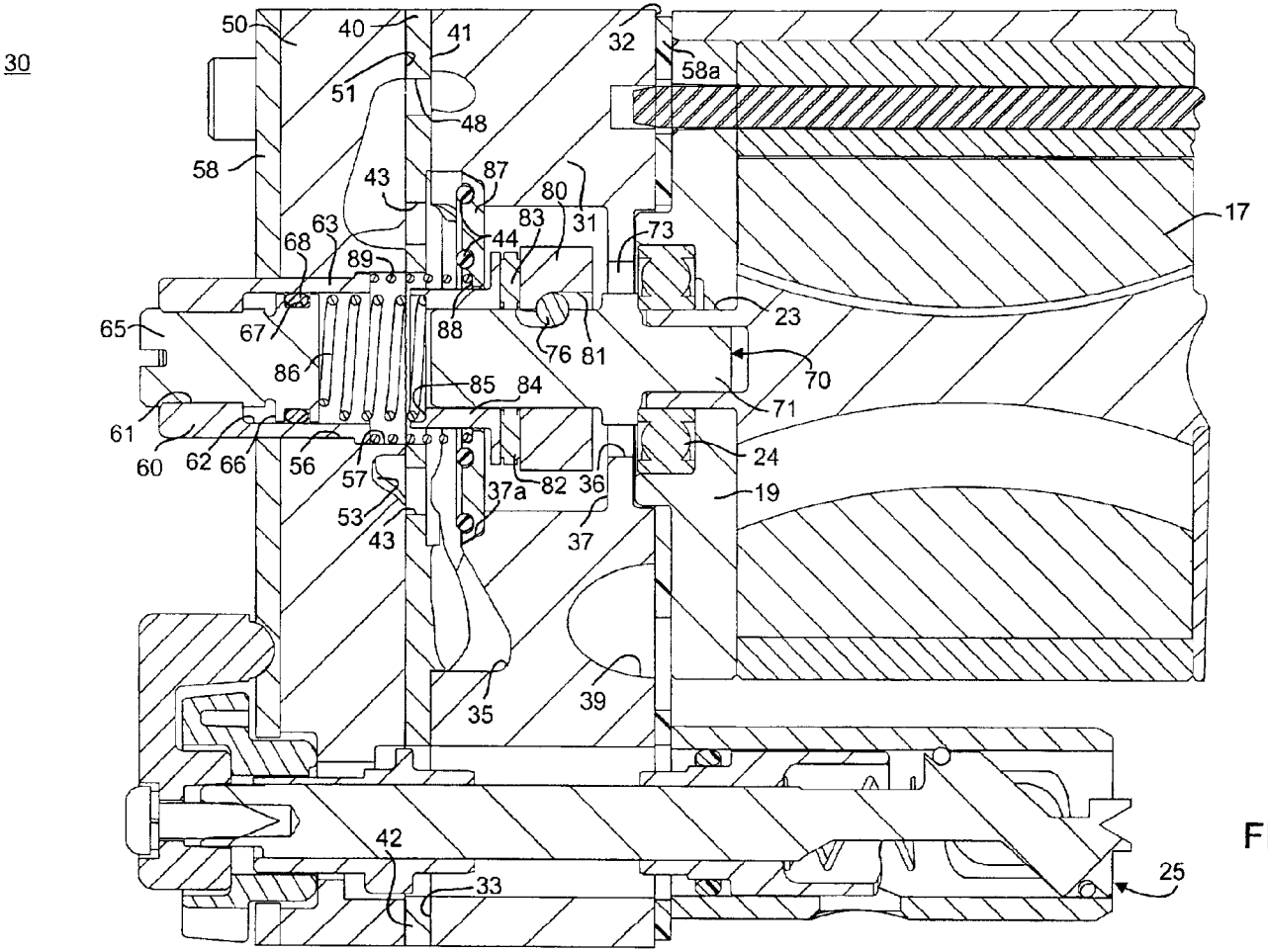
FIG. 2 is an enlarged, fragmentary view of a rear portion of FIG. 1 showing the automatic shutoff mechanism, showing one seal arrangement.
Figure 3:
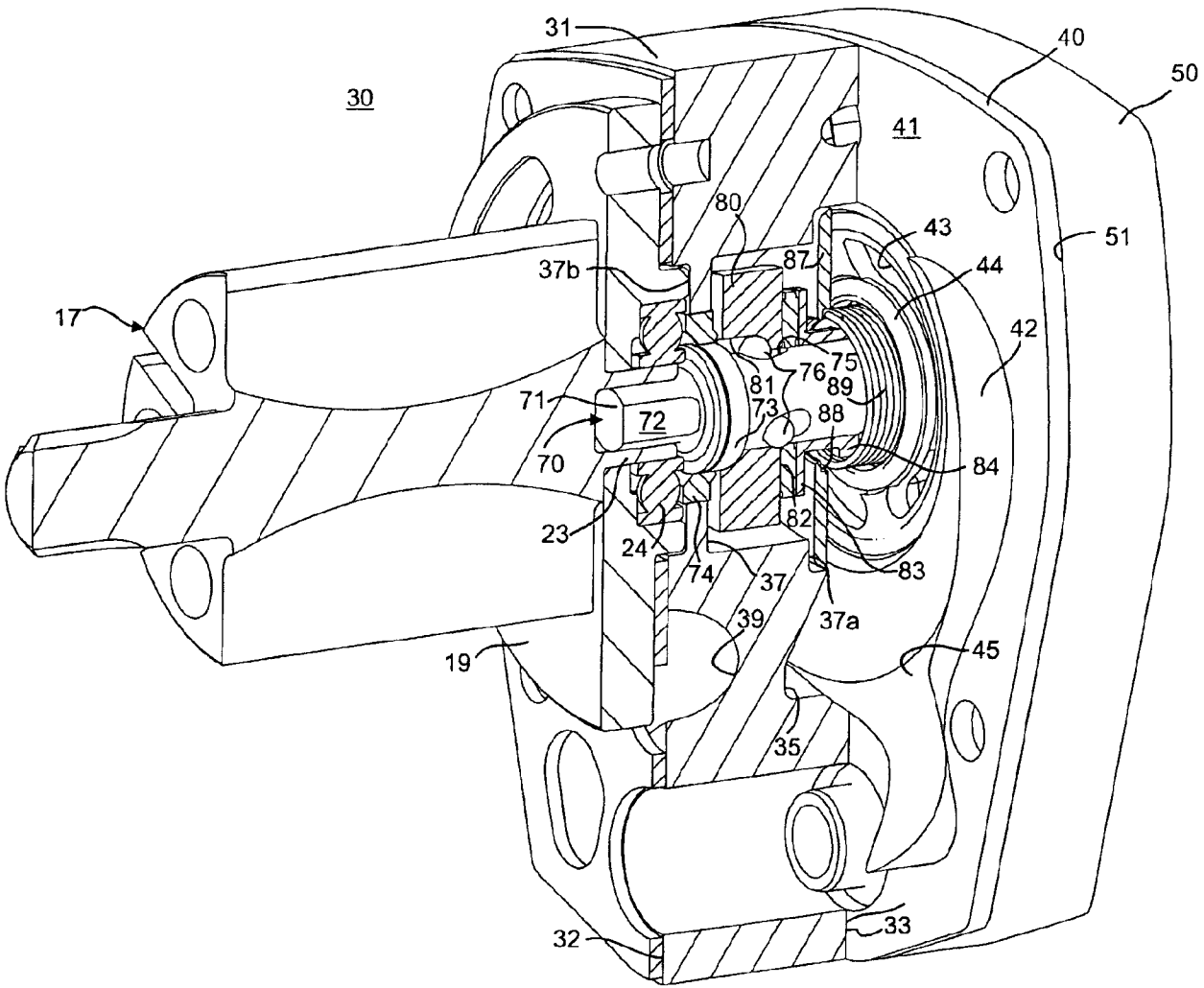
FIG. 3 is a fragmentary front perspective view in partial section of the automatic shutoff mechanism of FIG. 2, showing another seal arrangement.
Figure 4:
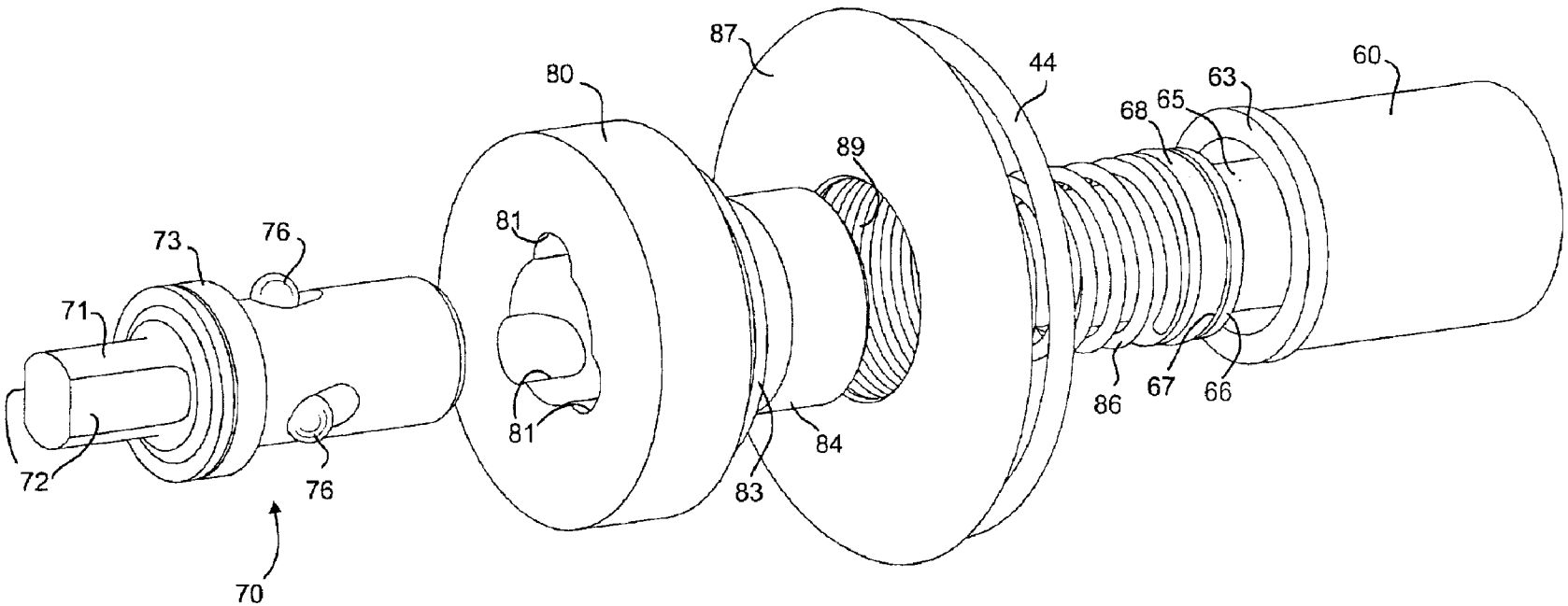
FIG. 4 is a further enlarged, exploded, front perspective view of the trip assembly of the automatic shutoff mechanism of FIG. 2.

The shutoff mechanism 30 also includes a valve seat 40 (FIG. 8) which is in the nature of a relatively thin plate having a front face 41 which is disposed in use against the rear face 33 of the valve plate 31 substantially congruent therewith (see FIGS. 2 and 3). Formed through the valve seat 40 are a pair of diametrically opposed, concentric arcuate apertures 43. Formed in the front face 41, respectively radially inwardly and outwardly of the arcuate apertures 43, are concentric circular grooves for receiving O-ring seals 44 (see FIG. 3). Also formed in the front face 41 is a generally Y-shaped groove 45 which is disposed so as to be matingly congruent with the Y-shaped groove 35 in the valve plate 31 for cooperation therewith to define a channel providing communication between the inlet port 34 and the arcuate apertures 43. Formed through the valve seat 40 is a circular central bore 46 concentrically inside the inner O-ring seal 44. Formed through the valve seat 40 adjacent to the upper end thereof is an arcuate aperture 48 disposed for registry with the port 38 in the valve plate 31.

The shutoff mechanism 30 also includes an end plate 50 which has a front face 51 (see FIG. 9) disposed in use against the rear face of the valve seat 40 substantially congruent therewith (see FIGS. 2 and 3). Formed in the front face 51 is an arcuate groove 53 which forms a nearly complete circle and terminates in radially outwardly extending legs 54. The groove 53 is positioned for registry in use with the arcuate apertures 43 in the valve seat 40, with the ends of the legs 54 being in registry with the arcuate aperture 48 in the valve seat 40. A central bore 56 is formed through the end plate 50 inside the arcuate groove 53 coaxially therewith for registry with the central bore 46 of the valve seat 40, the bore 56 being provided in the front face 51 with a shallow counterbore 57. An end cap 58 is disposed in use against the rear face of the end plate 50 substantially congruent therewith, and has a central bore 59 formed therethrough in registry with the central bore 56 of the end plate 50. In use, the front face 32 of the valve plate 31 is disposed against the rear end plate 19 of the air motor 15, being preferably spaced therefrom by a suitable gasket 58*a* (FIGS. 2 and 3). The valve plate 31, valve seat 40, end plate 50 and end cap 58 are secured together and to the motor 15 by suitable fasteners 59*a* (one shown in FIG. 1).

Referring in particular to FIGS. 1–4, the shutoff mechanism 30 also includes a hollow cylindrical plug insert 60 having an internally threaded bore 61 therethrough provided at the forward end thereof with a counterbore 62. Projecting radially outwardly from the front end of the plug insert 60 is an annular flange 63. In use, the plug insert 60 is received through the central bores 56 and 59 in the end plate 50 and in the end cap 58, with the flange 63 seated in the counterbore 57. A slotted adjusting screw 65 is threadedly engaged in the plug insert 60 and is provided with a radially outwardly projecting annular flange 66 having a circumferential groove 67 therein for receiving an O-ring seal 68 circumferentially sealing the forward end of the adjusting screw 65 against the counterbore 62 of the plug insert 60. Alternatively, the screw could have a lever that seats in circumferentially spaced detent recesses to facilitate manual adjustment and ensure repeatability of settings.

The shutoff mechanism 30 also includes a shaft extension 70 having a coupling end 71 with flats formed thereon and mateably receivable in the stub shaft 23 of the motor rotor 17 for rotation therein. Just rearwardly of coupling end 71 is a radially outwardly projecting annular flange 73 which is disposed in the central bore 36 of the valve plate 31 and is encircled by a lip seal 74. Formed in the outer surface of the shaft extension 70 rearwardly of the flange 73 are a plurality of circumferentially spaced helical grooves 75, which may be three in number, in each of which is seated a corresponding ball 76. The shaft extension 70 is coaxially encircled by an annular actuation member in the form of an inertia ring 80, which has plural helical grooves 81 formed in the inner surface thereof, respectively cooperating with the grooves 75 in the shaft extension 70 for forming helical tracks for the balls 76 and confining the balls therein. Provided on the rear face of the inertia ring 80 is an annular thrust bearing 82, which is engaged with an annular end flange 83 of a cylindrical thrust washer 84. The rear end of the cylindrical thrust washer 84 is counterbored to define an annular shoulder 85, against which is seated one end of a helical compression adjustment spring 86, the other end of which is seated against the flange 66 of the adjustment screw 65 (see FIG. 2).

The cylindrical thrust washer 84 extends through the center of an annular valve member in the nature of a disc valve 87, which seats in the counterbore 37*a* of the valve plate 31. The disc valve 87 has a annular counterbore 88 formed in the rear face thereof, in which is seated one end of a helical compression reset spring 89, the rear end of which is seated against the flange 63 of the plug insert 60 (see FIG. 2). It will be appreciated that the disc valve 87 is resiliently retained by the reset spring 89 in a normal open position seated in the valve plate counterbore 37*a*. This spring force also retains the plug insert 60 seated in the end plate counterbore 57. Also, the thrust washer 84 and the inertia ring 80 are biased forwardly to a normal rest or home position, shown in the drawings, by the adjustment spring 86 with a force which can be varied by the adjustment screw 65.

In operation of the air motor 15 in a forward or fastener-tightening direction, when the trigger valve assembly 14 is actuated, pressurized airflow will pass upwardly through the handle portion 13 of the housing, through the open trigger valve assembly 14, and then rearwardly through the inlet port 34 of the valve plate 31 to the rear face thereof, and then upwardly through the channel formed by the Y-shaped grooves 35 and 45, as indicated by the arrows in FIG. 2, then rearwardly through the arcuate apertures 43 in the valve seat 40 to the arcuate groove 53 and the end plate 50, to the ends of the legs 54, and then back forwardly through the arcuate aperture 48 in the valve seat 40 and the port 38 in the valve plate 31 to the rotor 17 of the air motor. Thus, it can be seen that this pressurized airflow path passes rearwardly of the disc valve 87, which is seated in its normally open position. The air pressure may serve to assist the reset spring 89 in urging the disc valve 87 to its seated open position in the counterbore 88.

As is well known, when a fastener is being run in, there will initially be negligible torque and the motor rotor 17, shaft extension 70 and inertia ring 80 will all rotate together. As torque builds up, the impact mechanism 21 will begin imparting impulses or impacts to the work piece. With each such impact, the rotor 17 and shaft extension 70 will momentarily stop. However, the inertia ring 80, which is not fixed to the shaft extension 70, will try to continue rotating. The continued rotation of the inertia ring 80 relative to the shaft extension 70 will cause the inertia ring 80 to move axially rearwardly by operation of the helical ball-and-groove coupling to the shaft extension 70, thereby driving the thrust washer 84 axially rearwardly against the urging of the adjustment spring 86. The extent of the axial movement will be proportional to the amount of torque applied. Immediately after the rotor 17 and the shaft extension 70 resume rotation, the thrust washer 84 and inertia ring 80 will be returned forwardly to their home positions under the urging of the adjustment spring 86.

Typically, each successive impact will exert a slightly higher torque than the preceding one. Thus, with each impact of the impact mechanism 21, the inertia ring 80 will move axially a slightly greater distance rearwardly, returning each time to its home position between impacts. Eventually, when a predetermined torque level is reached, corresponding with the adjustment setting of the adjustment screw 65, the inertia ring 80 will move rearwardly a sufficient distance that the end flange 84 of the thrust washer 84 will engage the front face of the disc valve 87, unseating it and pushing it rearwardly from its normal open position a slight distance into the pressurized airflow. This will expose the front face of the disc valve 87 to the pressurized airflow, the pressure of which will then slam the disc valve 87 rearwardly the rest of the way to a closed position, sealed against the O-rings 44 of the valve seat 40, thereby shutting off airflow through the arcuate apertures 48 in the valve seat 40, blocking airflow to the air motor 15 and shutting it off. It will be appreciated that the O-rings 44 could be located on the disc valve 87 instead of on the valve seat 40 (see FIG. 2). As soon as the operator releases the trigger valve assembly 14, the pressurized airflow from the source will be shut off, relieving the air pressure on the disc valve 87, and permitting it to return to its normal open position under the urging of the reset spring 89.

Thus, automatic shutoff of the tool 10 is accomplished at a predetermined torque level preventing over torquing of the work piece. It is significant that the disc valve 87 need be moved only a very small distance from its normal open position, typically in the range of from about 0.01 inch to about 0.02 inch, to permit the pressurized airflow to take over and drive the disc valve 87 to its closed position, thereby using the pressurized airflow to perform most of the work in overcoming the force exerted by the reset spring 89 and effecting a very rapid shutoff. The shutoff mechanism is easily adjusted to vary the shutoff torque, is very compact, with all parts located at the rear of the air motor, and is relatively inexpensive.

If the reversing valve assembly 25 is actuated to operate the air motor 15 in a reverse or fastener-loosening direction, the pressurized airflow path will be different, bypassing the shutoff mechanism 30, which is not needed, since there will be no torque limit to be concerned with. Thus, in this case, the airflow will be directed so that, at the front face 32 of the valve plate 31, it will not enter the inlet port 34, but will rather enter the reverse groove 39, which channels it directly to a reverse-direction inlet port in the motor rear end plate 19 without going past the disc valve 87.

Figure 11:
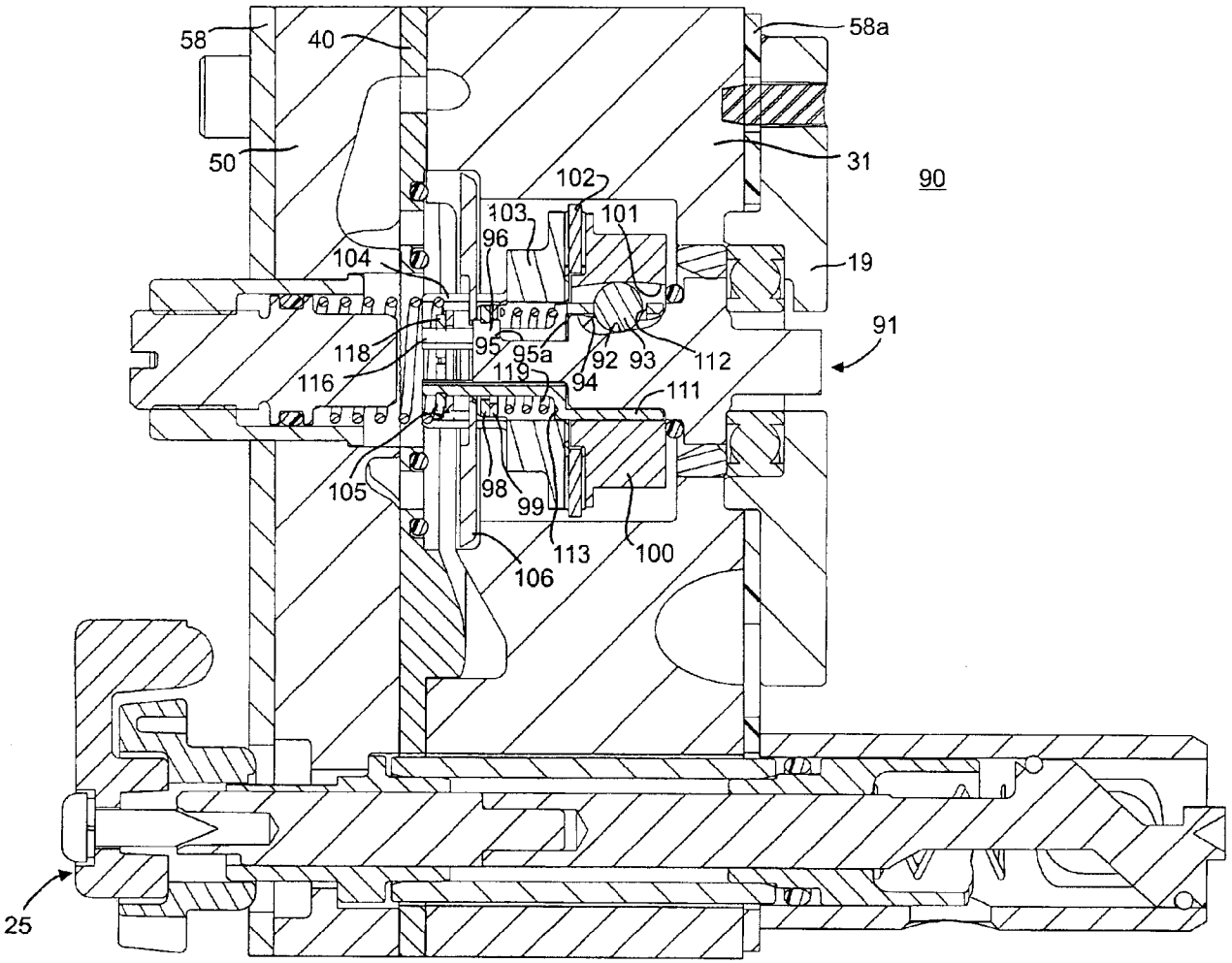
FIG. 11 is a view similar to FIG. 2 of another embodiment of automatic shutoff mechanism.
Figure 12:
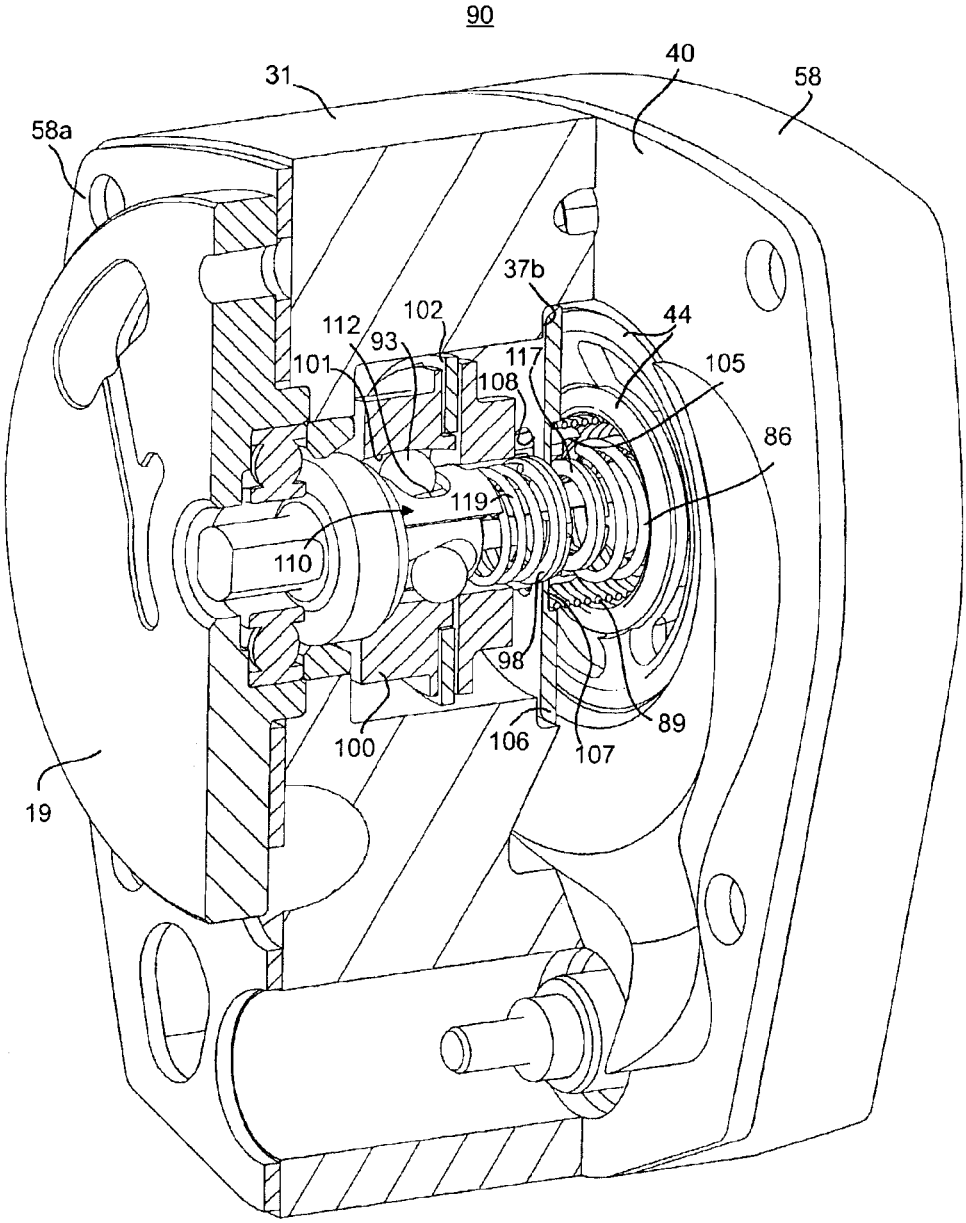
FIG. 12 is an enlarged view similar to FIG. 3 of the automatic shutoff mechanism of FIG. 11.
Figure 13:
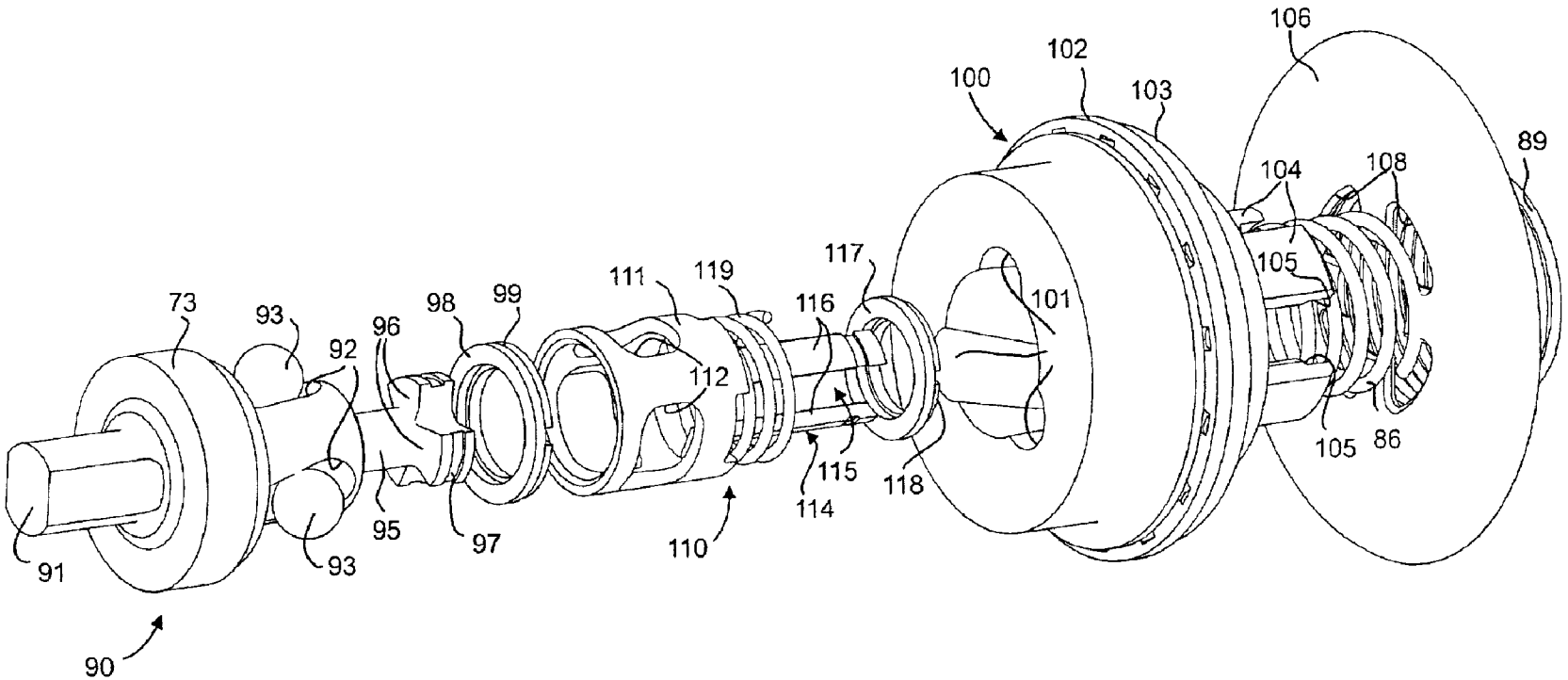
FIG. 13 is an enlarged, exploded, front perspective view of the trip assembly of the automatic shutoff mechanism of FIG. 11.

Referring now also to FIGS. 11–13, there is illustrated another embodiment of automatic shutoff mechanism, generally designated by the numeral 90, which utilizes substantially the same valve plate 31, valve seat 40, end plate 50 and end cap 58 described above in connection with the automatic shutoff mechanism 30 of FIGS. 1–10, and creates the same airflow paths. The same plug insert 60 and adjusting screw 65 are also used. The shutoff mechanism 90 utilizes a global shaft extension 91 which differs somewhat from the shaft extension 70, described above. The shaft extension 91 has plural helical grooves 92 formed in the outer surface thereof for respectively receiving balls 93. However, in this case, each of the helical grooves 92 has a sloping base or root 94, which is inclined so that the forwardmost end of the groove is further from the rotational axis than the rearwardmost end thereof, as can best be seen in FIG. 11. The shaft extension 91 has a reduced-diameter rearward end 95, provided at its distal end with a plurality of radially outwardly projecting spokes 96, which may be three in number, and cooperate to define a slotted annular ring provided with a circumferential groove 97 in its outer surface, in which are seated a washer 98 and retaining ring 99.

The shutoff mechanism 90 includes an inertia ring 100 which coaxially encircles the shaft extension 91 and has plural helical grooves 101 formed on the inner surface thereof for cooperation with the grooves 92 in the shaft extension 91 to form helical tracks for the balls 93. Mounted at the rear end of the inertia ring 100 is a thrust bearing 102 which engages the forward end of a thrust washer 103, which has at its rearward end a reduced-diameter cylindrical portion which is axially slotted to define a plurality of equiangularly spaced fingers 104, the inner surfaces of which are counterbored to define a part-annular shoulder 105.

The forward end of the adjustment spring 86 seats against the shoulder 105 on the fingers 104 of the inertia ring 100. The shutoff mechanism 90 also includes a disc valve 106, which is similar to the disc valve 87 described above and again seats in a normal open position in the counterbore 37*a* of the valve plate 41. However, the disc valve 106 is provided with a counterbore 107 and with a plurality of equiangularly spaced arcuate apertures 108 therethrough, shaped and dimensioned for respectively receiving therethrough the fingers 104 of the inertia ring 100. The disc valve 106 is retained in its open position by the reset spring 89 in the same manner as was described above with respect to the disc valve 87.

Disposed coaxially within the inertia ring 100 is a cylindrical reset sleeve 110 which has a main body 111 disposed in use coaxially between the helically grooved portions of the shaft extensions 91 and the inertia ring 100, the main body 111 having plural circumferentially extending slots 112 therein for respectively receiving the balls 93 therethrough. The main body 111 is integral at its rearward end with a radially inwardly extending annular shoulder 113, which is in turn integral at its radially inner end with a rearwardly projecting, reduced-diameter end portion 114 which has a plurality of equiangularly spaced axial slots 115 formed therein defining fingers 116, the outer surfaces of which are grooved adjacent to their distal ends for receiving therein a washer 117 and a retaining ring 118. When assembled, the radial spokes 96 of the shaft extension 91 will respectively project radially outwardly through the slots 115 of the reset sleeve 110, but remain inside the fingers 104 of the inertia ring 100, as can best be seen in FIG. 11. A helical compression reset spring 119 encircles the reset sleeve fingers 116, having one end thereof seated against the washer 117 and the other end thereof seated against the shoulder 113, for resiliently urging the reset sleeve 110 forwardly against the shoulder 95*a* of the shaft extension 91.

The operation of the shutoff mechanism 90 is similar to that of the shutoff mechanism 30, described above. However, in this case, with each impact of the impact mechanism 21, when the inertia ring 100 moves axially rearwardly relative to the shaft extension 91, it will not return to its normal home position before the next impact. Rather, the reset sleeve 110 cooperates with the sloping helical grooves 92 in the shaft extension 91 to operate as a clutch to prevent return of the inertia ring 100 between impacts. More specifically, it can be seen that the reset spring 119 continuously urges the reset sleeve 100 and, thereby, the balls 93, forwardly, continuously tending to wedge the balls 93 between the radially converging helical grooves 92 and 101. Thus, in response to an impact, the inertia ring 100 is permitted to move rearwardly through the helical groove-and-ball coupling action described above, but is prevented from returning forwardly to its home position by its wedging action of the balls. Thus, there is a step-wise or additive movement of the inertia ring 100 rearwardly until, when the predetermined torque is reached, the thrust washer 103 engages and unseats the disc valve 106, which is slammed to its closed position by the pressurized airflow stream in the manner described above. As the disc valve 106 moves to its closed position, it engages the washer 117 on the reset sleeve fingers 116, pulling the reset sleeve 110 and, thereby, the balls 93, rearwardly, releasing the clutch wedging action and permitting the inertia ring 100 to return to its home position under the urging of the adjustment spring 86. The disc valve 106 will be reset after release of the trigger valve assembly 14, in the same manner as described above.

Figure 15:
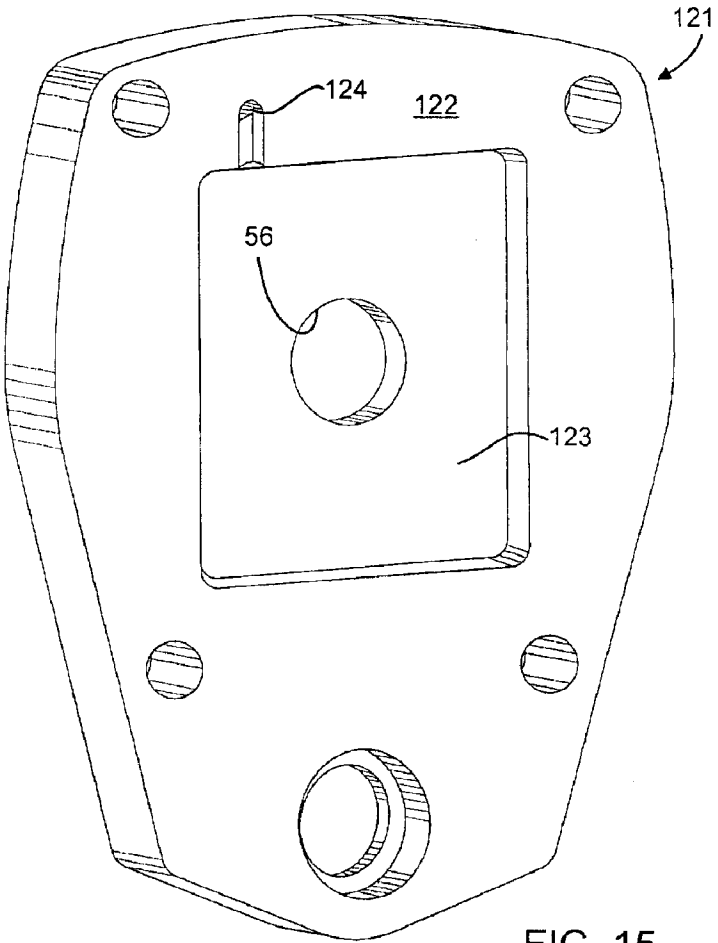
FIG. 15 is a rear perspective view of a modified end plate for use with the automatic shutoff mechanism of FIG. 14.
Figure 10:
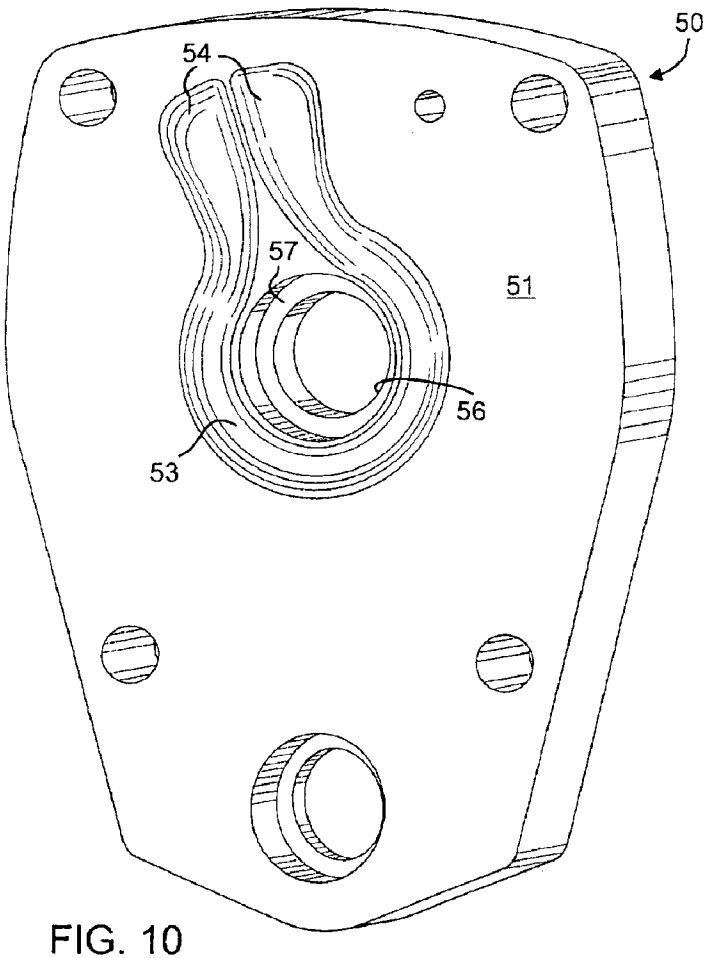
FIG. 10 is a front perspective view of the end plate of the shutoff mechanism of FIG. 3.
Figure 14:
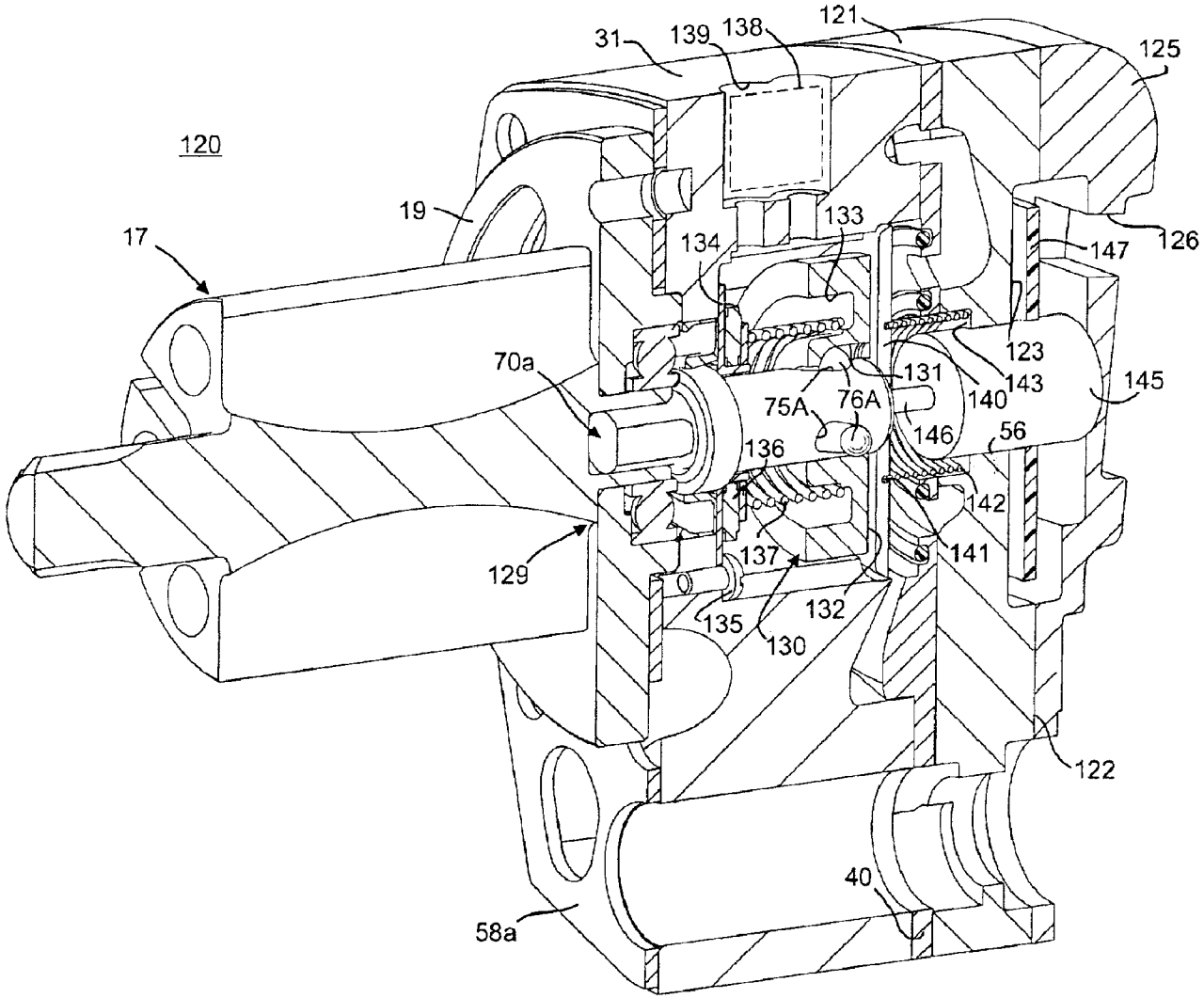
FIG. 14 is a view similar to FIG. 12 of another embodiment of automatic shutoff mechanism.

Referring now to FIGS. 14 and 15, there is illustrated another embodiment of automatic shutoff mechanism, generally designated by the numeral 120. Many of the parts of the shutoff mechanism 120 are the same as were used in the shutoff mechanisms 30 and 90, described above, and common parts in those several embodiments bear the same reference numerals. The shutoff mechanism 120 utilizes a modified end plate 121, which is similar to the end plate 50, described above, except that it has a rear face 122 in which is formed a rectangular circuit board recess 123 and an aperture 124 through the end plate 121 for circuit leads. The rear face 122 of the end plate 121 is covered, in use, by an end cap 125 (FIG. 14), which has therein a display window 126 for viewing a display which may form a part of a circuit board mounted in the recess 123.

The shutoff mechanism 120 includes a trip assembly 129, which includes a shaft extension 70A which is substantially the same as the shaft extension 70, described above, except that its helical grooves 75A are disposed adjacent to its distal end rather than adjacent to the flange 73. An inertia ring 130 encircles the shaft extension 70A and has helical grooves 131 on its inner surface which cooperate with the grooves 75A on the shaft extension 70A to perform helical tracks for balls 76A, in the manner described above, except that the helices are curved in the opposite direction. The inertia ring 130 has a radially inwardly extending annular end flange 132 at its forward end and has formed axially in the front surface thereof an annular groove 133. Encircling the shaft extension 70A adjacent to the flange 73 is an annular thrust washer 134 which is channel-shaped in transverse section and is secured to the valve plate 31 as by screws 135 (one shown). The thrust washer 134 seats a thrust bearing 136. A helical reset spring 137 has one end thereof seated against the thrust washer 134 and the other end thereof seated in the groove 133 of the inertia ring 130 for resiliently urging the inertia ring 130 rearwardly. A suitable magnetic sensor 138 is seated in a radial cavity 139 in the valve plate 31 immediately above the inertia ring 130.

A disc valve 140 is seated in the counterbore 37*a* of the valve plate 31 so that it is spaced a slight distance rearwardly of the inertia ring 130 in its normal home position illustrated in the drawings. Formed in the rear face of the disc valve 140 is an annular spring groove 141 in which is seated one end of a helical reset spring 142, the rear end of which is seated in a counterbore 143 in the end plate 121 for resiliently urging the disc valve 140 to its normal open position. Disposed in the central bore of the end plate 121 is a solenoid 145, which has a forwardly extending plunger or shaft 146 which extends through a central opening in the disc valve 140 and is connected to a suitable retainer on the front side of the disc valve 140. A circuit board 147 is seated in the circuit board recess 123 of the end plate 121 and is electrically connected to the solenoid 145 and to the sensor 138 by suitable leads (not shown). It will be appreciated that the circuit board 147 may include a suitable display which is visible through the display window 126 in the end cap 125, and may also be provided with suitable input devices, such as a push buttons or the like, which may extend through suitable apertures (not shown) in the end cap 125.

In operation, the inertia ring 130 will move axially back and forth in response to impacts delivered by the impact mechanism 21, in much the same way as was described above in connection with the shutoff mechanism 30, except that in this case the inertia ring 130 will move forwardly when the rotor extension 70A stops and will return rearwardly to its home position. These movements will be sensed by the sensor 138, which will output an electrical signal having a value proportional to the axial extent of the movement, which signal will be compared by a microprocessor or other suitable circuitry on the circuit board 147, with a preset signal level corresponding to a predetermined torque value, which may be input by the user through the input means described above. When the predetermined torque level is reached, the circuit board 147 will output a signal to the solenoid 145, which will actuate to pull the disc valve 140 a slight distance rearwardly into the air stream, causing it to slam to a closed position in the manner described above.

Figure 16:
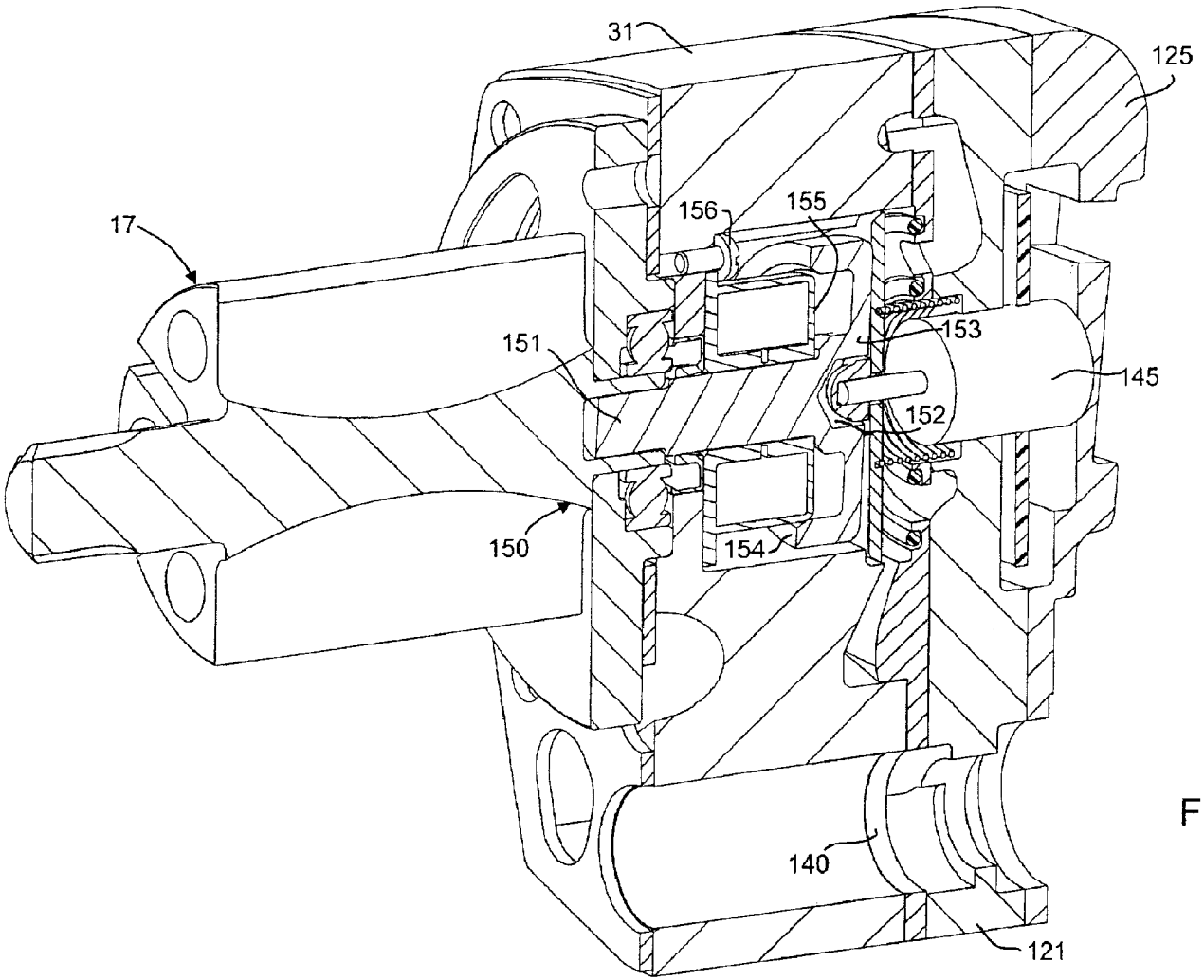
FIG. 16 is a view similar to FIG. 14 of another embodiment of automatic shutoff mechanism.

Referring now to FIG. 16, there is illustrated a trip assembly, generally designated by the numeral 150, which may be substituted for the trip assembly 129 in the shutoff mechanism 120 of FIG. 14. The trip assembly 150 has a modified shaft extension 151 provided at its end with a an axial bore 152 which receives the shaft 146 of the solenoid 145 and its associated coupler. Integral with the shaft extension 151 at its rear end is a radially outwardly extending annular end wall 153 which terminates at its radially outer edge in a forwardly projecting cylindrical flange 154. Encircling the shaft extension 151 is an annular bobbin sensor 155, which is a field sensor, which may be a magnetoelastic sensor of the type sold by Magna-Lastic Devices, Inc., or other contactless stress measuring device. The sensor 155 has an annular, radially outwardly extending flange at its forward end which is secured, as by fasteners 156, to the valve plate 31. The forward end of the cylindrical flange 154 of the shaft extension 151 may slightly overlap the bobbin sensor 155. The region of shaft extension 151 within the bobbin sensor 155 is specifically magnetized so that it can generate an electromagnetic field signal which can be sensed by the sensor 155 in a non-contact manner. The sensor 155 detects changes of torque through the magnetization and outputs a signal which is interpreted by the electronics on the circuit board 147 for measuring the amount of force reflected from the impact mechanism 21, which results in torsional stresses in the shaft extension 155 proportional to the torque applied and sensed by the sensor 155. The signal generated by the sensor 155 is proportional to the torque applied and is compared by the electronics on the circuit 147 to a predetermined reference torque level and, when they match, the solenoid 145 is actuated in the manner described above. If desired, the achieved torque value could then be displayed on the display of the circuit board 147 and the solenoid 145 is then deactivated, permitting the disc valve 140 to be returned to its normally opened position by the spring 142 when the trigger valve assembly 14 is released. A method of producing a circular magnetized, non-contact torque sensor of the type just described is disclosed in U.S. Pat. No. 5,887,335.

While, in the illustrated embodiments, the pneumatic tool 10 is a hand tool, it will be appreciated that the automatic shutoff principles disclosed herein would be applicable to other types of pneumatic devices. Also, while the illustrated embodiments are utilized in a torque-applying tool, it will be appreciated that the automatic shutoff principles disclosed herein, particularly those in the electromagnetic embodiments of FIGS. 14–16, could be used in pneumatic tools delivering other types of forces to a work piece, such as pneumatic hammers, chisels and the like. Also, while the illustrated embodiments have been shown as utilized in a torquing tool of the impact type, it will be appreciated that certain of the automatic shutoff principles herein could be utilized with other types of non-impact torquing tools.

From the foregoing, it can be seen that there has been provided an improved automatic shutoff mechanism for a pneumatic tool which is relatively simple, compact, inexpensive, fast-acting and easy to adjust.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An automatic shutoff mechanism for a pneumatic torque-applying tool having an air motor, a pressurized airflow path to the motor and a torquing mechanism driven by the motor, the shutoff mechanism comprising:

a valve member movable between a normal open position permitting pressurized airflow to the motor and a closed position blocking pressurized airflow to the motor, bias structure resiliently urging the valve member to its normal open position, the valve member having opposite first and second sides such that in the open position only the first side is exposed to pressurized airflow, and a trip apparatus responsive to application of a predetermined torque by the torquing mechanism for moving the valve member to a trip position in the airflow path spaced from the open position sufficiently that the second side of the valve member is exposed to pressurized airflow for driving the valve member from the trip position to the closed position.

2. The shutoff mechanism of claim 1, wherein the trip apparatus includes a mechanical apparatus.

3. The shutoff mechanism of claim 2, wherein the trip apparatus includes inertia-responsive apparatus.

4. The shutoff mechanism of claim 1, wherein the trip apparatus includes electromechanical apparatus.

5. The shutoff mechanism of claim 4, wherein the electromechanical apparatus includes a torque-sensing device and a solenoid coupled to the valve member and actuated by the torque-sensing device when the predetermined torque level is reached for moving the valve member to its trip position.

6. The shutoff mechanism of claim 5, wherein the torque-sensing device is disposed adjacent to the valve member.

7. The shutoff mechanism of claim 6, wherein the torque-sensing device includes an inertia-responsive device.

8. The shutoff mechanism of claim 6, wherein the torque-sensing device is an electromagnetic device.

9. The shutoff mechanism of claim 8, wherein the torque-sensing device includes a magnetoelastic torque sensor and a magnetic field vector sensor device.

10. An automatic shutoff mechanism for a pneumatic torque-applying tool having an air motor with a rotor shaft and a rotational axis, a pressurized airflow path to the motor and a torquing mechanism driven by the motor, the shutoff mechanism comprising:

a valve member movable between a normal open position permitting pressurized airflow to the motor and a closed position blocking pressurized airflow to the motor;

bias structure resiliently urging the valve member to its normal open position, the valve member having opposite first and second sides such that in the open position only the first side is exposed to pressurized airflow; and a trip assembly including an inertia member coaxial with the rotor shaft, and a helical coupling assembly between the inertia member and the rotor shaft such that at constant velocity the rotor shaft and the inertia member rotate together, while rapid deceleration of the rotor shaft causes the inertia member to move rotatably and axially relative to the rotor shaft to a position spaced from the valve member by a distance inversely proportional to the torque applied, the trip assembly being responsive to application of a predetermined torque for moving the inertia member into engagement with the valve member to move the valve member to a trip position in the airflow path spaced from the open position sufficiently that the second side of the valve member is exposed to pressurized airflow for driving the valve member from the trip position to the closed position.

11. The shutoff mechanism of claim 10, wherein the helical coupling assembly includes a first helical groove on an inner surface of the inertia member, a coupling member fixed to the rotor shaft and disposed coaxially within the inertia member and having a second helical groove on an external surface thereof, and at least one ball disposed in the first and second grooves for cooperation therewith to accommodate rotational and axial movement of the inertia member relative to the coupling member.

12. The shutoff mechanism of claim 11, wherein the trip assembly includes a bias structure for resiliently urging the inertia member to a home position spaced a maximum distance from the valve member.

13. The shutoff mechanism of claim 12, wherein the trip assembly includes a clutch mechanism responsive to movement of the inertia member from its home position for preventing return of the inertia member to the home position until after the valve member has been moved to its trip position.

14. The shutoff mechanism of claim 13, wherein at least one of the helical grooves has a first axial end disposed adjacent to the home position of the inertia member and a second axial end, wherein the first axial end is disposed further from the rotational axis than the second axial end, the trip assembly including means resiliently urging the at least one ball toward the first end of the at least one of the grooves.

15. The shutoff mechanism of claim 14, wherein the trip assembly further includes reset mechanism responsive to movement of the valve member toward its closed position for permitting return of the inertia member to its home position.

16. A pneumatic torque-applying tool comprising:

an air motor;

a structure defining a pressurized airflow path to the motor;

torquing mechanism coupled to the motor and driven thereby; and automatic shutoff mechanism including, a valve member movable between a normal open position permitting pressurized airflow to the motor and a closed position blocking pressurized airflow to the motor, bias structure resiliently urging the valve member to its normal open position, the valve member having opposite first and second sides such that in the open position only the first side is exposed to pressurized airflow, and a trip apparatus responsive to application of a predetermined torque by the torquing mechanism for moving the valve member to a trip position in the airflow path spaced from the open position sufficiently that the second side of the valve member is exposed to pressurized airflow for driving the valve member from the trip position to the closed position.

17. The tool of claim 16, wherein the shutoff mechanism is disposed at an end of the air motor opposite the torquing mechanism.

18. The tool of claim 16, wherein the torquing mechanism is an impact mechanism, the air motor having a rotational axis, the trip apparatus including an actuation member axially movable between a home position spaced a maximum distance from the valve member and an actuating position engageable with the valve member for moving valve member to its trip position.

19. The tool of claim 18, wherein the trip apparatus includes a coupling assembly accommodating movement of the actuation member, in response to each impact of the impact mechanism, from the home position an axial distance proportional the torque applied and then back to the home position, until the valve member is moved to its trip position.

20. The tool of claim 18, wherein the trip apparatus includes a clutch assembly preventing return of the actuation member to its home position between impacts of the impact mechanism.

21. An automatic shutoff mechanism for a pneumatic impact tool having an air motor, a pressurized airflow path to the motor and an impact mechanism driven by the motor, the shutoff mechanism comprising:

a valve member movable between a normal open position permitting pressurized airflow to the motor and a closed position blocking pressurized airflow to the motor, bias structure resiliently urging the valve member to its normal open position, and a trip apparatus responsive to application of a predetermined reactive force to the impact mechanism for moving the valve member to a trip position in the airflow path spaced from the open position a distance such that the valve member is exposed to a pressurized air load which drives valve member to the closed position.

22. The shutoff mechanism of claim 21, wherein the trip apparatus includes a torque-responsive mechanism.

23. The shutoff mechanism of claim 21, wherein the trip apparatus includes an electromechanical apparatus.

24. The shutoff mechanism of claim 23, wherein the trip apparatus includes a reactive force-sensing device and a solenoid coupled to the valve member and actuated in response to the force-sensing device when a predetermined reactive force is reached for moving the valve member to its trip position.

25. An automatic shutoff mechanism for a pneumatic tool having an air motor, a pressured air flow path to the motor and output mechanism driven by the motor for applying force to a work piece, the shutoff mechanism comprising:

a valve member movable between a normal open position permitting pressurized airflow to the motor and a closed position blocking pressurized airflow to the motor;

bias structure resiliently urging the valve member to its normal open position; and a trip assembly responsive to application of a predetermined reactive force to the output mechanism for moving the valve member to a trip position, the trip assembly including a reactive force responsive device responsive to the reactive force on the output mechanism to generate a signal indicative of the reactive force, and an actuator assembly responsive to the signal indicative of the predetermined reactive force level for moving the valve member to a trip position in the airflow path spaced from the open position sufficiently that the valve member is exposed to pressured airflow for driving the valve member from the trip position to the closed position.

26. The shutoff mechanism of claim 25, wherein the output mechanism is a torquing mechanism, the reactive force responsive device being a torque-responsive device.

27. The shutoff mechanism of claim 26, wherein the torque-responsive device is disposed adjacent to the valve member.

28. The shutoff mechanism of claim 27, wherein the torque-responsive device includes a mechanical device axially movable in response to torque applied.

29. The shutoff mechanism of claim 27, wherein, the torque-responsive device is an electromagnetic device.

30. The shutoff mechanism of claim 29, wherein the torque-responsive device includes a magnetoelastic device.

31. The shutoff mechanism of claim 25, wherein the actuator assembly includes a solenoid.

32. The shutoff mechanism of claim 25, wherein the output mechanism is an impact mechanism.

* * * * *